US007294071B1

(12) United States Patent
Saumell

(10) Patent No.: US 7,294,071 B1
(45) Date of Patent: Nov. 13, 2007

(54) METHOD AND DEVICE TO TRAIN A BASEBALL SWING

(76) Inventor: Jorge E. Saumell, 8410 SW. 36th St., Miami, FL (US) 33155-3202

( * ) Notice: Subject to any disclaimer, the term of this patent is extended or adjusted under 35 U.S.C. 154(b) by 22 days.

(21) Appl. No.: 11/167,351

(22) Filed: Jun. 27, 2005

(51) Int. Cl.
*A63B 69/00* (2006.01)
*A63B 69/40* (2006.01)

(52) U.S. Cl. ..... 473/451; 473/418

(58) Field of Classification Search ..... 473/418, 473/451, 431, 422, 135; 124/56, 75
See application file for complete search history.

(56) References Cited

U.S. PATENT DOCUMENTS 3,887,182 A * 6/1975 Breslow ..... 273/450
4,564,195 A 1/1986 McClure et al.
4,575,080 A 3/1986 Miles
4,858,921 A 8/1989 Eustice et al.
4,877,243 A * 10/1989 Taylor ..... 473/451
5,011,144 A 4/1991 Marello et al.
5,145,176 A * 9/1992 Lipson ..... 473/135
5,160,131 A * 11/1992 Leon ..... 473/451
D415,805 S 10/1999 Wygonik
2002/0198068 A1 12/2002 Jordan

* cited by examiner

*Primary Examiner*—Mitra Aryanpour
(74) *Attorney, Agent, or Firm*—Lawrence J. Gibney, Jr.

(57) ABSTRACT

This device will train an individual to strike a baseball. It is used for beginners as well as some of the advanced players by allowing the ball to be forced into different directions to simulate various pitching maneuvers.

1 Claim, 5 Drawing Sheets

METHOD AND DEVICE TO TRAIN A BASEBALL SWING

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This is a device which relates to a baseball training device and specifically a device to teach an individual to hit a baseball. A stream of air is used to suspend the ball or direct the travel of the ball in a certain direction.

B. Prior Art

Other baseball training devices do exist in the prior art and specifically, those related to ball suspending apparatus and method. A representative example of this is Euscice, U.S. Pat. No. 4,858,921. Another example is McClure, U.S. Pat. No. 4,564,195. Both of these devices use a stream of air to suspend a ball in a certain position so that a baseball player or as in McClure a tennis player may strike the ball in the appropriate fashion.

Another example is Miles, U.S. Pat. No. 4,575,080 and a similar idea is found in Euscice. Euscice teaches a nozzle, that can be bent slightly to produce the feel of a baseball being pitched to the individual.

None of the devices however use a blower motor, which can alternate the position of the nozzle automatically or manually and alternate positions so that it can give the feel of an inside pitch, outside pitch or directly over the plate pitch.

BRIEF SUMMARY OF THE INVENTION

This device rests on a base. A housing, which is secured to the base, contains a blower motor and all associated electrical connections. The blower motor provides a stream of air through a nozzle to suspend a ball or "pitch" a ball.

The blower motor is turned on and off by a switch and the stream of air is directed through the top of the housing through a nozzle. The nozzle can be bent to provide direction to the pitch. The device can be operated through either battery or by alternating current.

In another embodiment the position of the nozzle can be varied to produce a more realistic feel to simulate a pitched ball. This is accomplished by using a pulley system to vary the position of the nozzle.

Because the device will be used in outdoor environments the base and housing should be durable and hard plastic is probably a preferred choice of material.

In operation the blower motor is turned on and produces a stream of air which is directed through a nozzle. A ball is placed over the nozzle. The ball may be positioned in a vertical position over the stream of air for the beginner. Additionally, the nozzle may be tilted to allow the ball to travel to the batter for the more advanced batter. The angle of the nozzle will not exceed an angle of thirty degrees from the vertical position.

Additionally, the nozzle can be positioned in several different positions using a nozzle position pulley assembly which will alternate the position of the nozzle to give the batter a true feel for different locations of pitches. This embodiment would be useful for the experienced hitter.

Hand controls may also be used to operate the device remotely.

DETAILED DESCRIPTION OF THE EMBODIMENT

This device to simulate a pitch can be operated in three separate and distinct manners: the ball is suspended in the air by a stream of air in a vertical position, the ball is directed by bending the nozzle to no more than thirty degrees to simulate a "pitch" for the batter, and the direction of the ball automatically changes positions by the use of a positioning motor to simulate different types of "pitches".

First Embodiment

Figure 1:
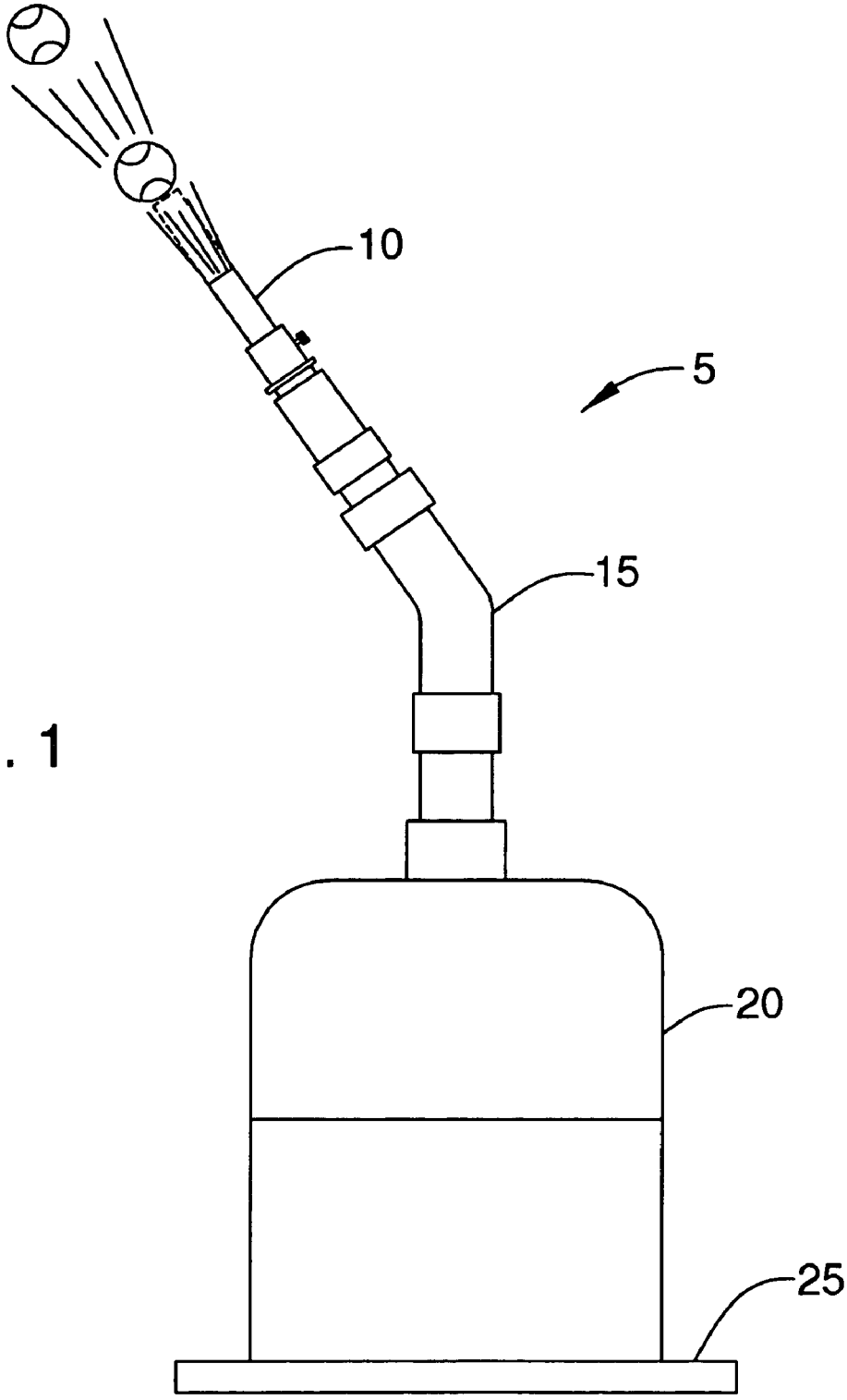
FIG. 1 is a front view of the device with a nozzle bent.
Figure 2:
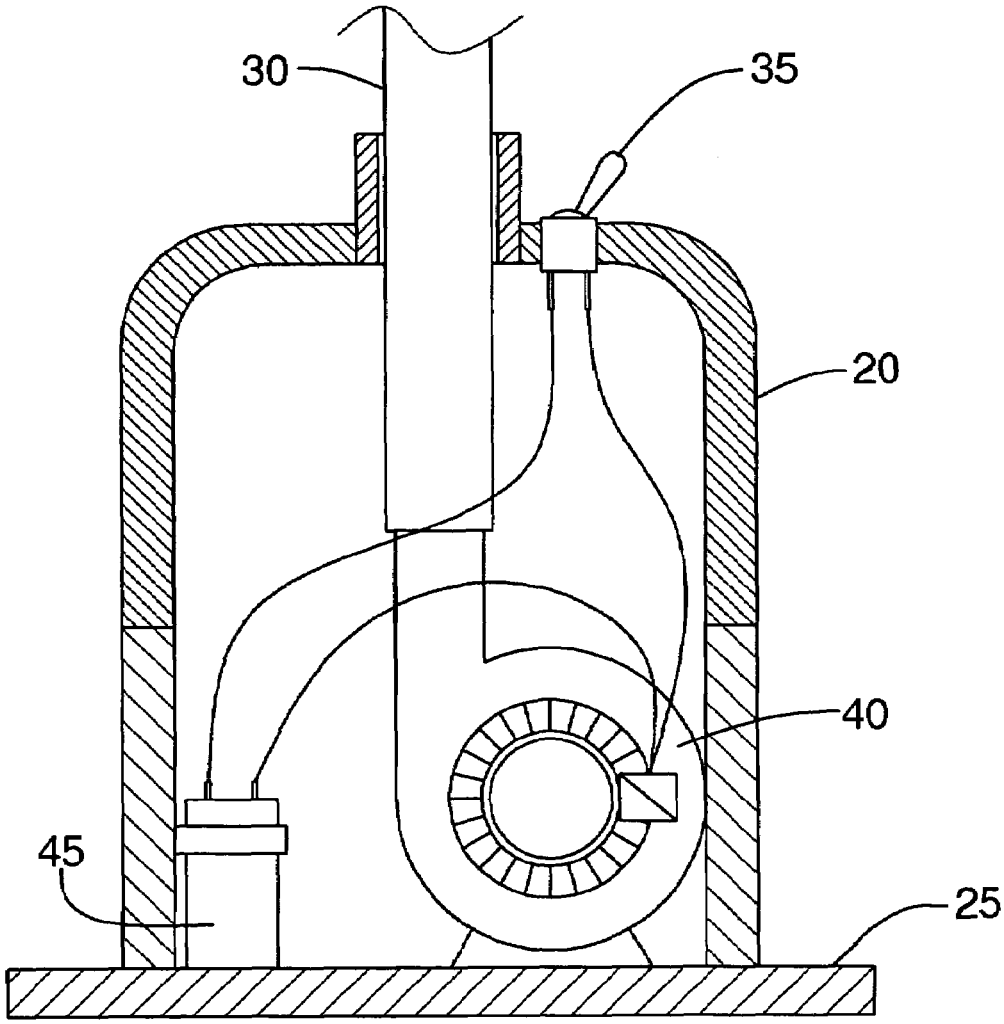
FIG. 2 is a cross sectional view of the housing of the device.

The device 5 rests on a base 25, which supports a housing 20 and all internal parts. The housing 20 protects the internal workings of the device 5 including a blower motor 40, power source 45 and all necessary electrical connections. FIGS. 1, 2

The blower is powered by an on/off switch 35 and a power source 45. The power source 45 may be either a battery, a plurality of batteries of alternating current. In FIG. 2 a battery 45 is depicted to operate the blower 40. The blower 40 will emit a stream of air which will be directed through the nozzle pivot support 30 and through the nozzle 10. FIG. 1 A ball is then placed on top of the stream of air over the nozzle 10 in this embodiment. The stream of air will suspend the ball in the air so that the individual can become accustomed to hitting a ball while it is suspended in the air. Persons who are inexperienced in the art of hitting a ball will likely use the first embodiment. This embodiment will teach the proper mechanics of hitting a ball. Although baseballs are mentioned, this may also be used in any sport where striking a ball is important, such as tennis.

Second Embodiment

In an alternative embodiment the housing 20 and base 25 are the same. Additionally the on/off switch 35 and blower 40 mechanism are also identical.

In the second embodiment, the nozzle 10 is tilted by a nozzle pivot support 15 at an angle of no more than thirty degrees from a vertical position. A ball is then placed in the stream of air, which is created by the blower 40, and the ball is propelled towards the better in order to simulate a "pitch". The second alternative embodiment is depicted in FIG. 1.

The bending of the nozzle pivot support 15, which is coupled to the nozzle support 30, will train the batter to strike the ball as it is directed toward them. This is more representative of a pitch being directed at the batter and it is contemplated to be used be more experienced individuals.

Third Embodiment

Figure 4:
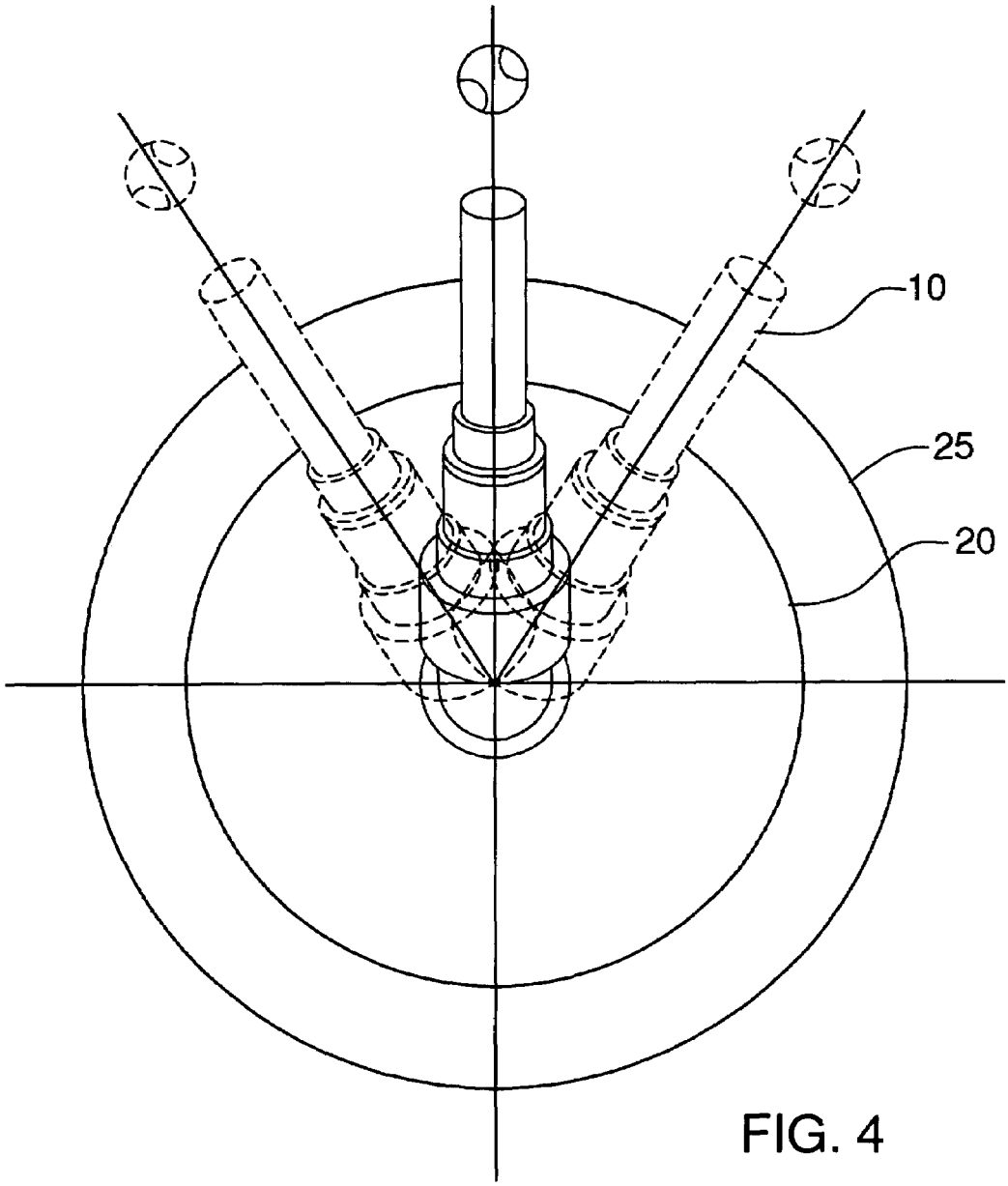
FIG. 4 is a top view of the device showing the various positions of the nozzle.

A third embodiment allows the nozzle 10 to be rotated automatically from position to position as depicted in FIG. 4.

Figure 3:
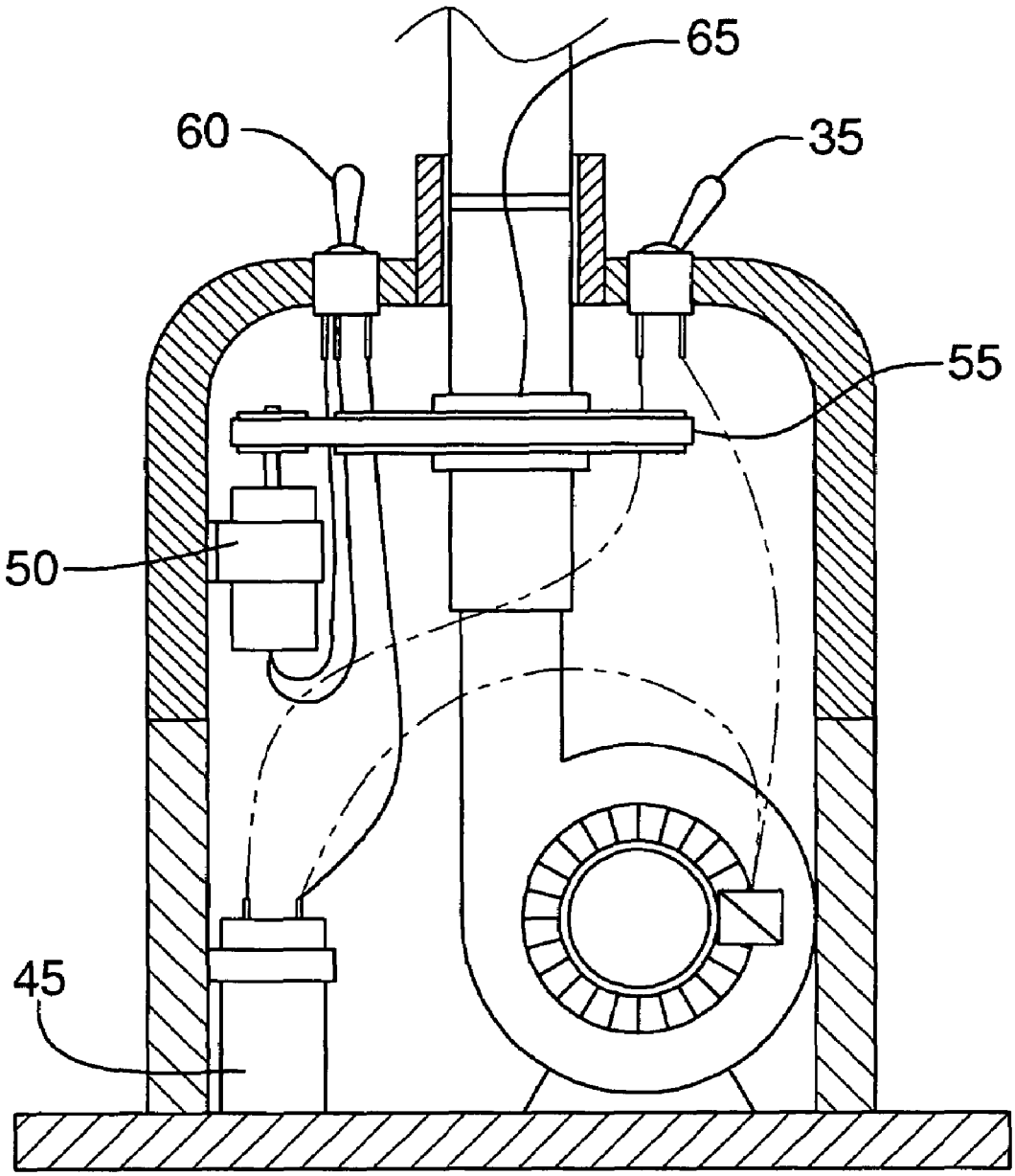
FIG. 3 is a cross sectional view of the interior housing showing an alternative embodiment.

FIG. 3 represents the mechanical connections of the third embodiment and includes all the electrical connections provided in the first two embodiments but also include a three way switch for positioning 60, a positioning motor 50 as well as a positioning pulley assembly 55. Additionally there is a slip coupling 65 to allow for alternate ball directions.

The positioning switch 35 allows the nozzle to automatically move direction. The positioning switch 35 operated a small electric motor, which operates the positioning pulley assembly 55. The positioning pulley assembly 55 is connected to a slip coupling 65 which allows the position of the nozzle 10 to change as depicted in FIG. 4.

This change of direction of the nozzle will allow the device to simulate a variety of pitches from a variety of angles. As the ball is directed towards the batter in different locations, the batter is trained to hit different types of "pitches". This device would simulate an inside pitch, an outside pitch, as well as a pitch directly over the plate. This gives the person being trained a better feel for pitches and will likely be used by more experienced bat handlers.

Figure 5:
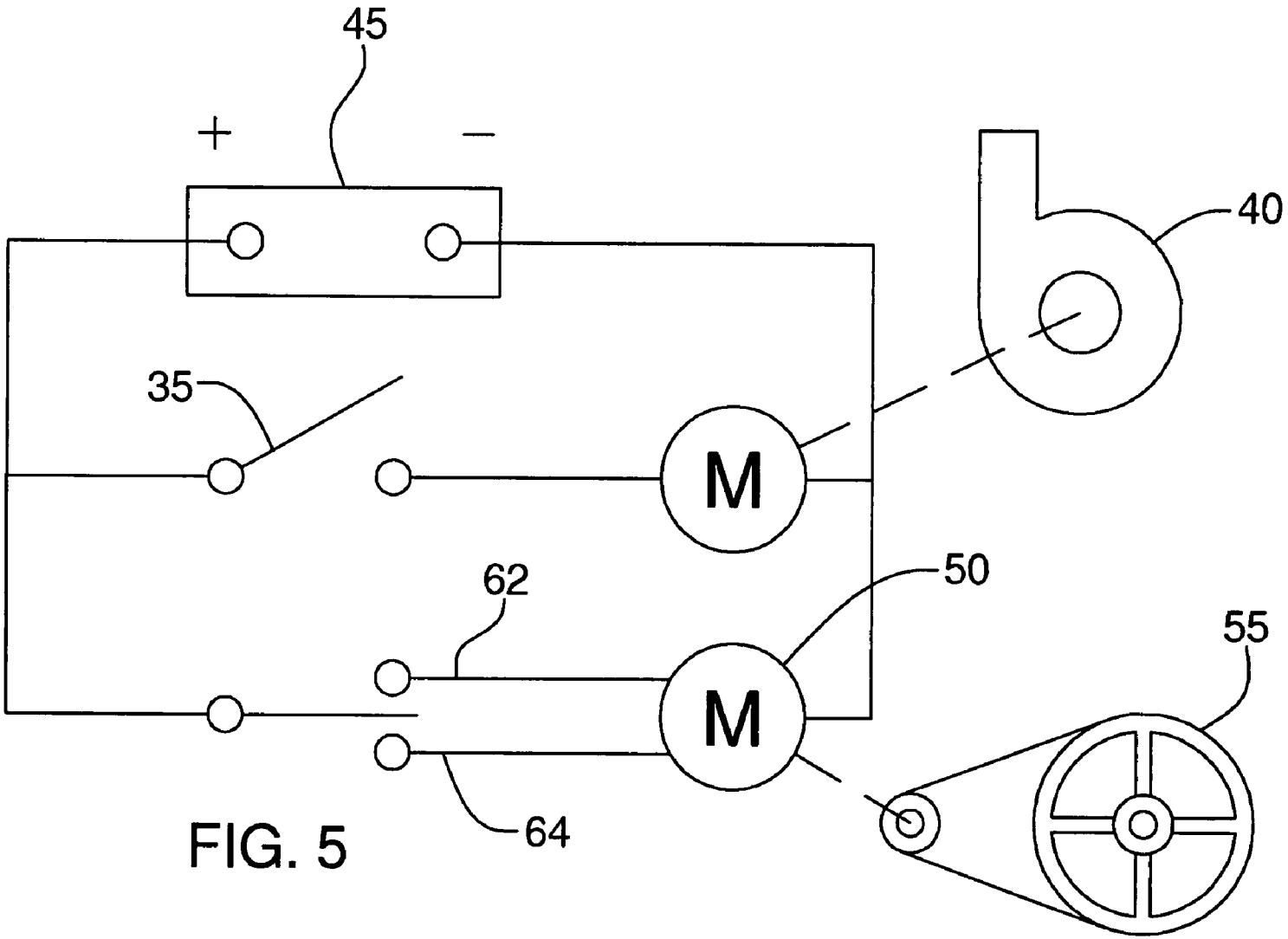
FIG. 5 is a schematic of the electrical part of this device.

FIG. 5 is a representation of the electrical schematic of the device. The nozzle motor 50 controls a nozzle positioning assembly 55. The three way switch dictates a clockwise rotation 62 or a coupler clockwise rotation 64 of the nozzle depending on the specific position of the switch.

Fourth Embodiment

In another embodiment controllers can be added to this device. These hand controllers allow the coach or instructor to move the housing to the right or left or stop it in one position. This will allow even more flexibility with regard to the position of the "pitches" for the individual who is being trained.

Separate power cords are used for each of the controllers in addition to two separate manual controllers and two hand buttons to control the direction of the "pitch".

The invention claimed is:

1. A device to train an individual to strike a baseball, which is comprised of:

a. a housing;
b. a base;
c. a nozzle;
d. a blower;
e. a nozzle support;
f. a nozzle pivot support;
g. a positioning motor;
h. a three way positioning switch;
i. a slip coupling;
j. a positioning pulley assembly;

wherein the housing rests on the base;

appropriate electrical connections are provided to operate the blower;

wherein a power source is provided;

said blower produces a stream of air;

wherein the blower directs the stream of air through a nozzle;

wherein the nozzle support is joined to the blower;

wherein the nozzle pivot support is joined to the nozzle support;

wherein the nozzle is joined to the nozzle pivot support;

wherein the nozzle pivot support allows the direction of the air stream to be changed;

wherein the positioning motor operates a positioning pulley assembly;

wherein the positioning pulley assembly is connected to a slip coupling and a pulley operated by the motor;

said slip coupling allows different positions of the nozzle;

said three way switch for positioning allows the nozzle to be rotated automatically throughout the various planes.

* * * * *